US005356077A

United States Patent [19]

Shames et al.

[11] Patent Number: 5,356,077

[45] Date of Patent: Oct. 18, 1994

[54] PULSATING SHOWER HEAD

[76] Inventors: Sidney J. Shames, 57 Holly Pl., Briarcliff Manor, N.Y. 10510; Harold Shames, 5 Agnes Cir., Ardsley, N.Y. 10502

[21] Appl. No.: 179,430

[22] Filed: Jan. 10, 1994

[51] Int. Cl.[5] ..... B05B 1/08; B05B 1/16; B05B 1/18

[52] U.S. Cl. ..... 239/383; 239/447

[58] Field of Search ..... 239/380–383, 239/443–449

[56] References Cited

U.S. PATENT DOCUMENTS 3,762,648 10/1973 Deines et al. .
3,801,019 4/1974 Trenary et al. .
3,963,179 6/1976 Tomaro .
4,068,801 1/1978 Leutheuser .
4,079,891 3/1978 Kwan .
4,141,502 2/1979 Grohe .
4,190,207 2/1980 Fienhold et al. .
4,204,646 5/1980 Shames et al. .
4,254,914 3/1981 Shames et al. .
4,324,364 4/1982 Buzzi et al. .
4,330,089 5/1982 Finkbeiner ..... 239/449
4,588,130 5/1986 Trenary et al. .
5,033,897 7/1991 Chen ..... 239/449
5,090,624 2/1992 Rogers .
5,294,054 3/1994 Benedict et al. ..... 239/383

*Primary Examiner*—Karen B. Merritt

[57] ABSTRACT

A pulsating shower head that employs a rotor for effecting the discharge of a pulsating spray, a continuous spray, or a combination of both comprising an upper body housing, a lower body housing, a stem housing affixed to the lower body housing, a stem affixed to the upper body housing and held in slidable relation to the stem housing, a spray plate affixed to the stem housing, a nozzle plate held in fixed relation to the spray plate and stem housing, and a rotor. Rotation of the lower body housing and stem housing with respect to the stationary stem causes the selective discharge of either a pulsed spray through a first set of jet-discharge apertures, a continuous spray through a second set of jet-discharge apertures, or a combination of both pulse spray and jet spray. The stem comprises a tangentially outwardly facing groove that provides a sliding watertight seal between the stem and the stem housing and acts to close off pulse or spray apertures in the stem housing as desired. The shower head may be incorporated into either a wall mounted unit or a hand held unit.

4 Claims, 5 Drawing Sheets

PULSATING SHOWER HEAD

BACKGROUND

1. Field Of The Invention

This patent relates to a shower head from which a regular spray or a pulsating spray may be selectively discharged. More particularly, this patent relates to a shower head made of molded plastic parts and with simplified means for directing water flow to either a spray chamber or a pulse chamber.

2. Description Of The Related Art

Numerous shower heads are known in the art that can be adjusted to discharge either a continuous spray or a pulsating spray. Typical of such shower heads are those disclosed in U.S. Pat. Nos. 3,801,019, 4,068,801, and 4,254,914. U.S. Pat. No. 3,801,019, for example, discloses a spray nozzle capable of delivering both spray and pulse, and employing three sets of flow passages. Control of the frequency of pulsation or the apportionment of spray is accomplished by adjusting a shuttered plate relative to a flow directing plate. U.S. Pat. No. 4,068,801 discloses a spray head in which the water is caused to rotate and drive a rotor. The rotor has openings that pass intermittently across jet nozzles (for pulsating spray) or perforations (for steady spray).

Our U.S. Pat. No. 4,204,646 discloses a pulsating shower head having a rotor, an upstream housing means, and a downstream housing member. The upstream housing means comprises an upstream transverse wall having concentric walls that define a rotor chamber within which the rotor can rotate. Either steady spray or pulse spray may be achieved by rotating the downstream housing member, causing it to move axially with respect to the upstream housing member. When the downstream housing member and the upstream housing member are spaced closest together, the rotor is driven, resulting in a pulse spray. When the downstream housing member and the upstream housing member are spaced farthest apart, a continuous spray is effected. At intermediate settings, both pulse and continuous sprays are achieved.

To varying degrees, such spray or pulsating shower heads utilize relatively complex and expensive constructions. Thus a need exists for a shower head capable of delivering either a continuous or pulse spray while having a relatively simple construction that is inexpensive to produce. The present invention meets these needs, providing a simple pulsating shower head design with relatively few parts that can be assembled from one direction. The present invention is unique in that it employs a tangentially mounted rubber gasket to close off water ports for alternately providing pulsating or continuous spray or a combination of both.

SUMMARY OF THE INVENTION

It is, therefore, an object of the present invention to provide a shower head capable of delivering either a continuous or pulse spray, or a combination continuous and pulse spray.

A further object of the present invention is to provide a pulsating shower head of relatively simple construction that can be assembled from one direction.

Another object of the present invention is to provide a pulsating shower head that employs a rubber gasket tangentially mounted on a stem to close off water ports, thus diverting water into either a spray chamber to provide continuous spray, a pulse chamber to provide pulse spray, or both chambers to provide a combination of continuous and pulse spray.

Further and additional objects will appear from the description, accompanying drawings, and appended claims.

These and other objects are achieved by a pulsating shower head comprising an upper body housing, a lower body housing, a stem housing affixed to the lower body housing, a stem configured to be received by the upper body housing, a spray plate affixed to the stem housing, a nozzle plate interposed between the spray plate and the stem housing, and a rotor.

The upper body housing has a cup-shaped outer wall, a downstream extending inner wall and a center stem. The lower body housing has an outer wall of approximately the same circumference as the upper body housing outer wall, and an inner wall for receiving the stem housing. The stem housing is configured to fit within the lower body housing and has an upstream portion comprising a substantially cylindrical wall with two apertures therein for directing water flow. The stem housing also has a downstream portion comprising a substantially cylindrical wall having internally facing threads for receiving a spray plate.

The stem is configured to be received by the upper body housing center stem and has a unique tangentially outwardly facing groove for holding a rubber gasket and a circumferential groove downstream of the tangentially outwardly facing groove for holding a second rubber gasket. The rubber gaskets provide a sliding watertight seal between the stem and the stem housing.

The spray plate has a transverse wall with a first set of jet-discharging apertures therethrough and inner and outer substantially cylindrical walls extending upstream from the transverse wall. The transverse and cylindrical walls define an annular rotor chamber. The transverse wall and the lower body housing define a second set of jet-discharging apertures.

The nozzle plate is interposed between the spray plate transverse wall and the downstream portion of the stem housing and is held in fixed relation therewith. The nozzle plate has a plurality of tangentially directed flow channels which direct jets of water downstream thereof into the rotor chamber at a rotor driving velocity. The rotor is rotatably mounted in the rotor chamber.

Rotation of the lower body housing and stem housing with respect to the stationary stem causes the selective discharge of either a pulsed spray through the first set of jet-discharge apertures or a continuous spray through the second set of jet-discharge apertures, or a combination of both pulse spray and jet spray.

The shower head may be incorporated into either a wall mounted unit of the type shown in FIGS. 1–3 or a hand held unit of the type shown in FIG. 4.

DETAILED DESCRIPTION OF THE INVENTION

Figure 1:
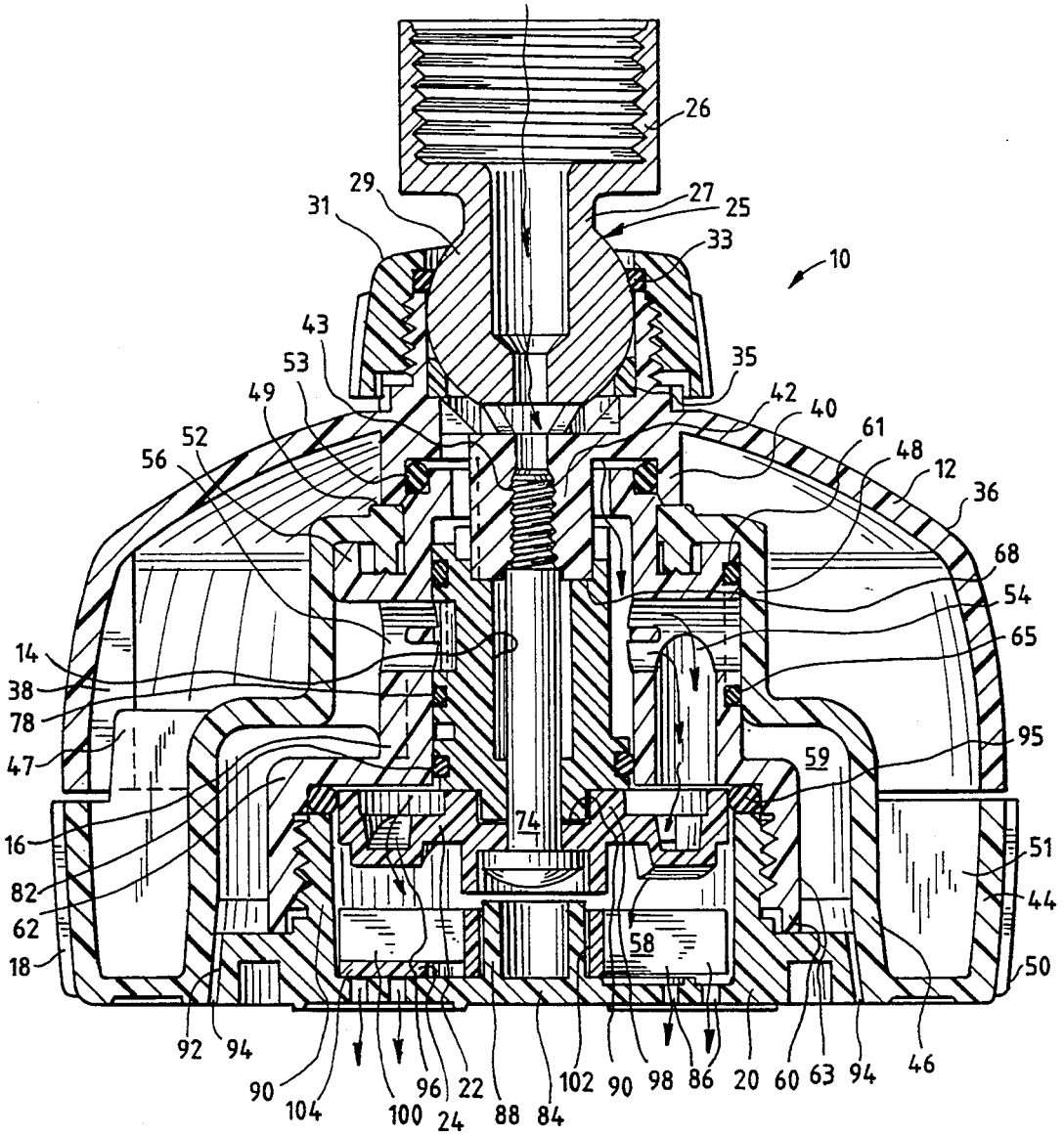
FIG. 1 is a cross-sectional view of the pulsating shower head of the present invention, the cross section being taken on a vertical plane substantially through the axis of the shower head, showing the shower head in the pulsating mode.

Turning to the drawings, there is shown in FIG. 1 a cross-sectional view of the pulsating shower head 10 of the present invention, the cross section being taken on a vertical plane substantially through the axis of the shower head 10, showing the shower head 10 in the pulsating mode. The shower head 10 comprises an upper body housing 12, a stem 14 held in fixed relation to the upper body housing 12, a stem housing 16, a lower body housing 18, a spray plate 20, a nozzle plate 22 and a rotor 24.

Figure 2:
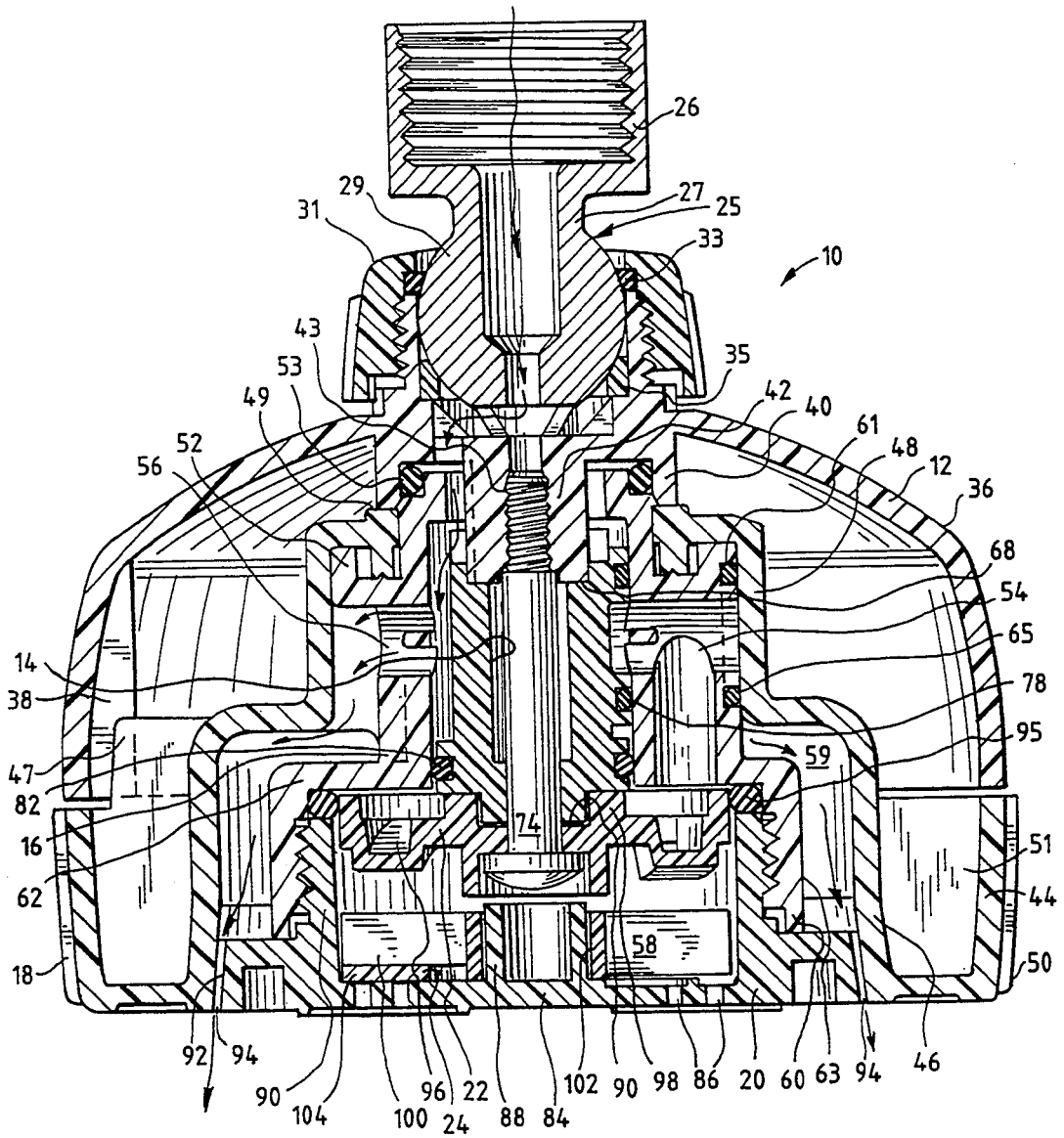
FIG. 2 is a cross-sectional view of the pulsating shower head of the present invention, the cross section being taken on a vertical plane substantially through the axis of the shower head, showing the shower head in the continuous spray mode.
Figure 3:
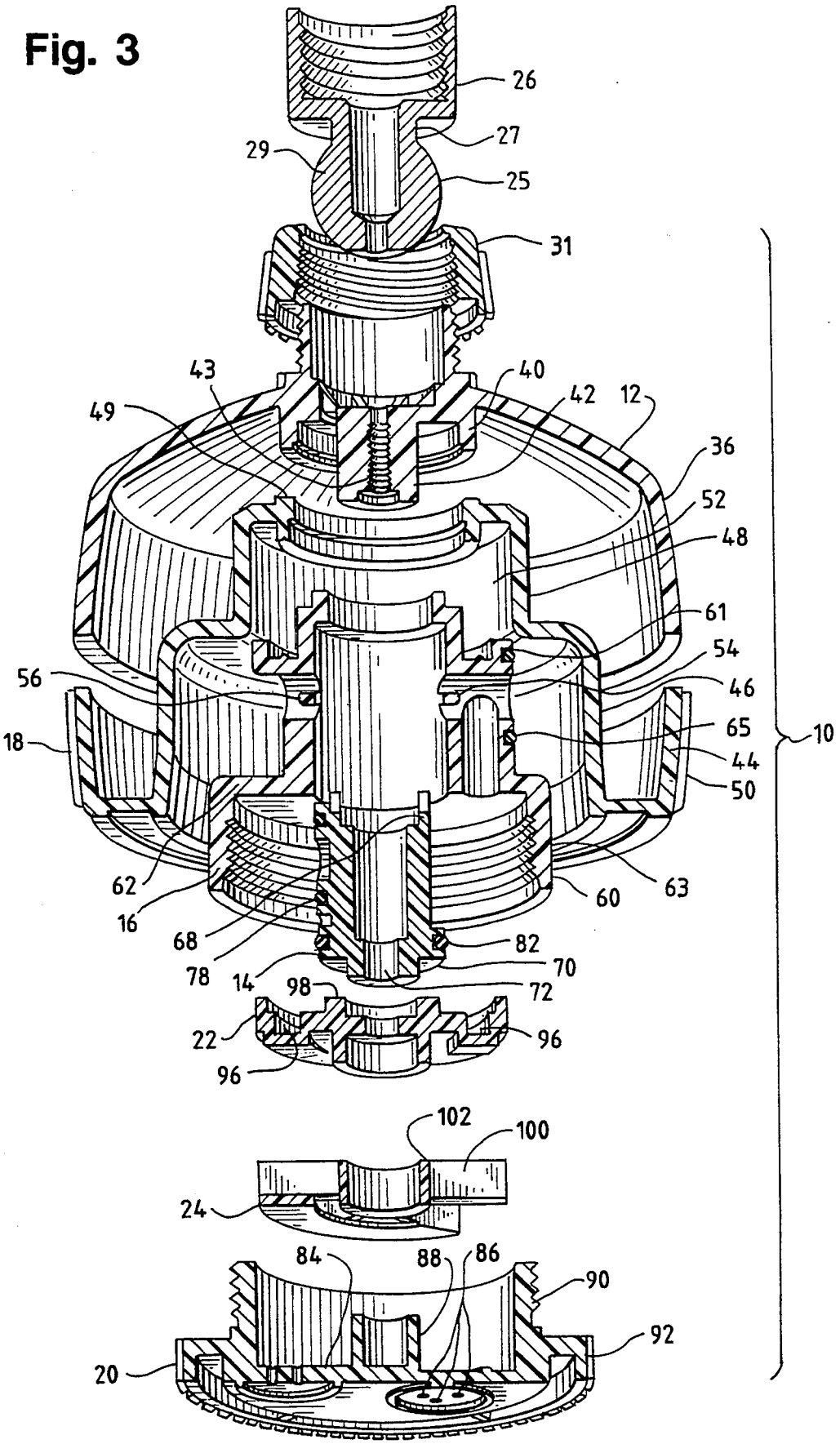
FIG. 3 is an exploded, slightly reduced, partially fragmentary, perspective view of the shower head of FIGS. 1 and 2.
Figure 4:
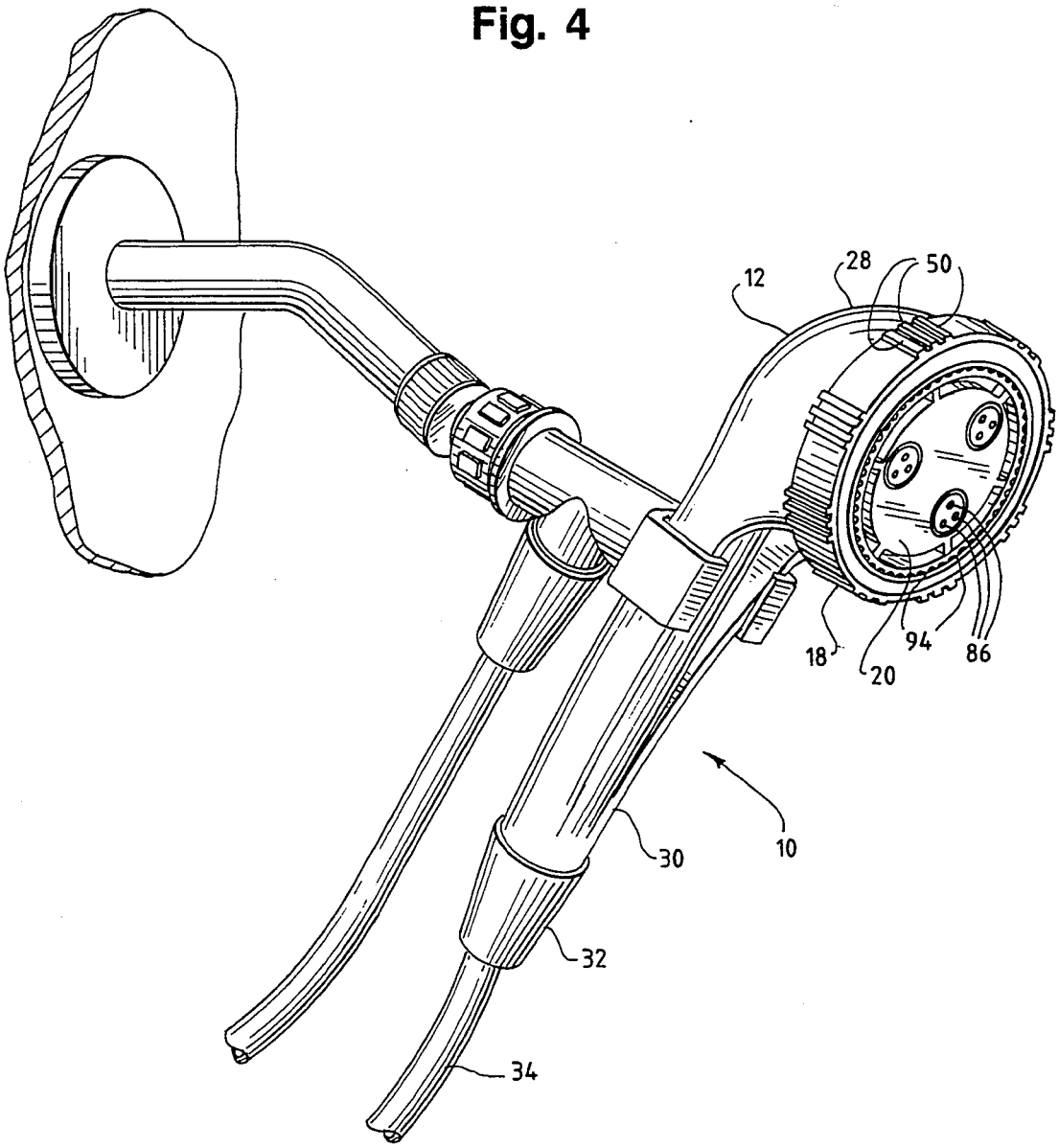
FIG. 4 is a perspective view of one form of the shower head adapted to be connected to the end of a flexible hose for hand-held operation.

The shower head 10 may be used as either a wall mounted unit as shown in FIGS. 1–3, or as a hand held unit as shown in FIG. 4. In the wall mounted unit embodiment, the upper body housing 12 is molded of plastic and is configured to accept a female-threaded coupling means at its upstream end for connecting to a water source, which is typically a male threaded pipe end (not shown). The coupling means includes a ball connector 25 that provides, integrally as one part, an upstream, female-threaded, coupling portion 26 adapted for connection to a male-threaded pipe end, a bored spacer neck 27, and a downstream, axially bored, pivot ball 29. A molded annular coupling nut 31, of greater inner diameter than pivot ball 29, is assembled onto the ball 29, and held thereto by retainer ring 33. The molded annular coupling nut 31 is threaded onto the upper body housing 12. Seated between the upper body housing 12 and the ball 29 there is provided a soft elastic watertight gasket 35. This gasket 35 must be soft enough yet elastic enough to provide sufficient friction with the ball 29 so that the upper body housing 12 does not rotate when the lower body housing 18 is rotated by the user.

In the hand held unit embodiment (FIG. 4), the upper body housing 12 is molded of plastic to provide a downstream cup-shaped end 28 and an upstream tubular shaped connector end 30. The connector end 30 is provided with a male threaded fitting (not shown) that cooperates with a female fitting 32. The female fitting 32, in turn, is connected to the end of a flexible water supply hose 34.

The upper body housing 12 comprises a cup-shaped outer wall 36 having two radially inwardly extending ribs 38 spaced about 95 degrees apart (one of which is shown in FIGS. 1 and 2). The ribs 38 limit the rotation of the lower body housing 12, as described more fully below. The upper body housing 12 also comprises a downstream extending substantially cylindrical inner wall 40 and an axially-bored center stem 42 provided with axially extending thread means 43 therein. These elements on the upper body housing 12 are specifically constructed and arranged to receive and engage portions of the shower head parts that will now be described.

The lower body housing 18 is also formed of plastic and comprises an outer wall 44, a middle wall 46, and an inner wall 48. Preferably, the outer wall 44 is provided with ribs 50 for easy gripping by the user. Reinforcement ribs 51 are provided between the middle 46 and outer 44 walls for strength. In addition, a stepped rib 47 interposed between the outer 44 and middle 46 walls acts in conjunction with the upper body housing ribs 38 to limit the movement of the lower body housing within an approximately 270 degree sweep. As will be explained below, this 270 degree adjustment allows for pulse spray, continuous spray, or a combination of pulse and continuous spray.

The lower body housing inner wall 48 is configured to receive the stem housing 16. In the preferred embodiment, the upstream portion 52 of the stem housing 16 is welded to the inside of the inner wall 48. The upstream portion 52 has at least two apertures 54, 56 therein for directing water flow. At least one aperture, hereinafter referred to as the pulse aperture 54, communicates with and directs water into the rotor chamber 58. At least one other aperture, hereinafter referred to as the spray aperture 56, communicates with and directs water to the cylindrical channel 59 defined by the lower body housing middle wall 46 and a downstream portion 60 of the stem housing 16. The stem housing upstream portion 52 has a tangentially outwardly facing groove 61 for retaining a rubber gasket 65. This rubber gasket 65 provides a watertight seal between the stem housing 16 and the lower body housing inner wall 48. The stem housing downstream portion 60 comprises a transverse wall 62 and a substantially cylindrical wall 63 downstream thereof having threads for receiving and engaging the spray plate 20.

As already noted, the stem housing 16 is welded to the lower body housing 18 so that both rotate relative to the stem 14. The lower body housing/stem housing assembly is positioned inside the upper body housing 12 such that the upstream edge 49 of the lower body housing 18 abuts the upper body housing inner wall 40. A small rubber gasket 53 seated inside the upper body housing inner wall 40 and provides a watertight seal between the upper body housing 40 and the stem housing 16.

Figure 5:
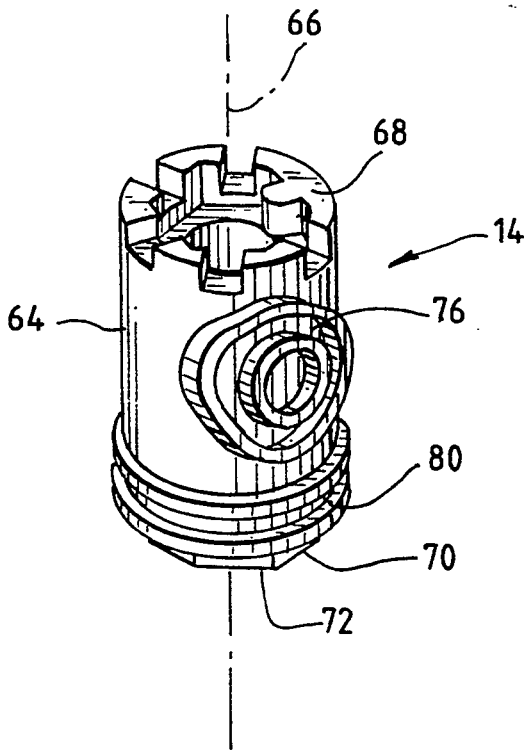
FIG. 5 is an enlarged perspective view of the stem that is shown in vertical cross-section in FIGS. 1 and 2.

As best shown in FIG. 5, the stem 14 comprises a substantially cylindrical wall 64 defining a center axis 66 and having upstream and downstream ends 68, 70. The upstream end 68 is configured to, receive the upper body housing center stem 42 and to be held in fixed relation thereto. The downstream end 70 has a centrally disposed aperture 72 therein for receiving a bolt 74. The stem wall 64 is formed with a unique tangentially outwardly facing groove 76 for holding a first rubber gasket 78 (not shown in FIG. 5). The stem wall 64 also is formed with a circumferentially outwardly facing groove 80 downstream of the tangentially outwardly facing groove 76 for holding a second rubber gasket 82 (not shown in FIG. 5). The stem wall 64 is concentric with and held in slidable relation to the stem housing 16. The first and second rubber gaskets 78, 82 provide sliding watertight seals between the stem 16 and the stem housing 16.

The spray plate 20 has a transverse wall 84 with a first set of jet-discharging apertures 86 therethrough and inner and outer substantially cylindrical walls 88, 90 extending upstream from the transverse wall 84. The transverse and cylindrical walls define the annular rotor chamber 58. The outer edge 92 of the transverse wall 84 and the lower body housing middle wall 46 define a second set of jet-discharging apertures 94. A large rubber gasket 95 is interposed between the spray plate outer wall 90 and the transverse wall 62 of the stem housing, providing a watertight fit therebetween.

The nozzle plate 22 is interposed between the spray plate transverse wall 84 and the downstream portion 60 of the stem housing 16 and is held in fixed relation therewith. The nozzle plate 22 has a plurality of tangentially directed flow channels 96 which direct jets of water downstream thereof into the rotor chamber 58 at a rotor driving velocity. The nozzle plate 22 also comprises an upstream extending inner wall 98 which seats around the downstream end 70 of the stem 14.

The rotor 24 is rotatably mounted about the spray plate inner wall 88 in the rotor chamber 58 and comprises a plurality of equally circumferentially spaced vanes 100 extending radially from a sleeve type center hub 102. Arcuate shaped webs 104 located at the downstream end of the rotor 24 extend between selected vanes 102 and are integral with the downstream edges thereof. The inner bore of the rotor center hub 102 is of a size to provide for sliding and rotation about the spray plate inner wall 88.

Figure 6:
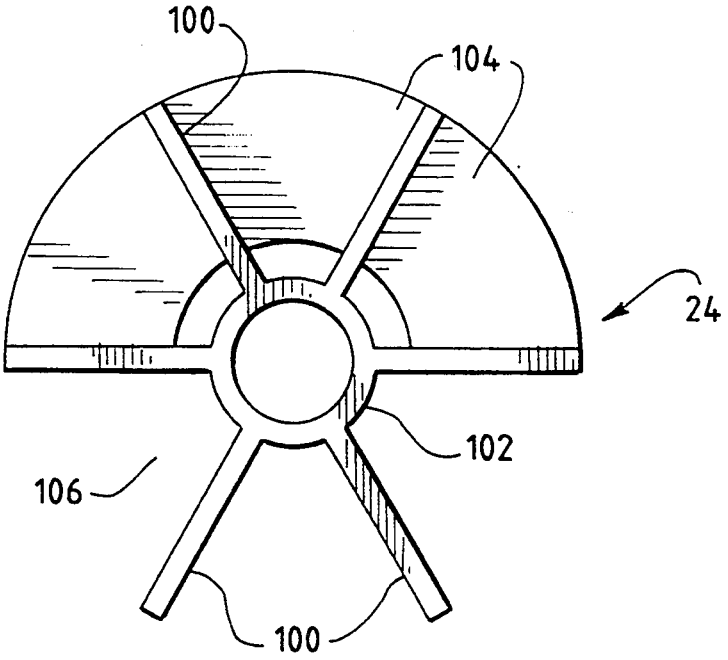
FIG. 6 is an enlarged top plan view of the rotor that is shown in vertical cross-section in FIGS. 1 and 2.

In the preferred embodiment shown in FIG. 6, six vanes 100 radiate from the center hub 102. The arcuate extent of the web 104 is such as to bridge the space included between four vanes, but leaving three adjacent flow through channels 106 through the rotor 24.

The invention is used in the following manner. The lower body housing 18 and the stem housing 16 are rotated together with respect to the stem 14, which is stationary. Rotation of the lower body housing 18 and stem housing 16 causes the selective discharge of either a pulsed spray through the first set of jet-discharge apertures 86 or a continuous spray through the second set of jet-discharge apertures 94, or a combination of both pulse spray and jet spray. FIG. 1 shows the position of the parts when the lower body housing 18 and stem housing 16 are rotated into the pulse position. At this point, the stem housing first rubber gasket 78 has formed a watertight seal around the spray aperture 56 of the stem housing 16. In this position, the flow of water (designated by arrows) is directed through the pulse aperture 54, through the tangentially directed flow channels 96 in the nozzle plate 22 and into the rotor chamber 58. The jets of water entering the rotor chamber 58 impinge on the rotor vanes 100 causing the same to rotate rapidly with a minimum of friction. Since the webs 104 and through channels 106 of the rotor 24 alternately pass above each set of first jet-discharge apertures 86, there is produced a pulsating discharge through the apertures 86 that will be projected from the shower head 10.

When the lower body housing 18 and the stem housing 16 have been rotated with respect to the stem 14 into the spray position shown in FIG. 2, the pulse aperture 54 of the stem housing is sealed by the stem first rubber gasket 78, thereby preventing the flow of water into the rotor chamber 58. Instead, the flow of water (designated by arrows) is directed through the stem housing spray aperture 56 and into the space between the stem housing upstream portion 52 and the lower body housing inner wall 48. From there the water flows through the cylindrical space defined by the stem housing downstream portion 60 and the lower body housing middle wall 46 and exits the shower head 10 in a continuous spray through the apertures 94 defined by the lower body housing middle wall 46 and the spray plate outer edge 92.

To achieve a combination pulse and continuous spray, the lower body housing 18 and stem housing 16 are rotated to a position between the pulse position and the spray position. In this intermediate position, both the pulse and spray apertures 54, 56 are at least partially open, that is, not sealed by the first rubber gasket 78, and water flows through both apertures and ultimately through both first and second jet-discharge apertures 86, 94.

As can be readily ascertained from the preceding description and the accompanying figures, the present invention can be assembled from one direction, unlike many conventional pulsating shower heads. Such a construction makes the present invention relatively inexpensive to manufacture. Beginning with the upper body housing 12, the present invention may be assembled in the following order: upper body housing 12, small rubber gasket 53, lower body housing 18, stem housing 16 (with rubber gasket 65), stem 14 (with first and second rubber gaskets 78, 82), nozzle plate 22, large rubber gasket 95, bolt 74, rotor 24, and spray plate 20.

While particular embodiments of this invention have been shown and described, it will be obvious to those skilled in the art that various changes and modifications may be made therein without departing from the scope and spirit of the invention, and, therefore, it is intended in the appended claims to cover all such changes and modifications which fall within the true scope and spirit of the invention.

We claim as our invention:

1. A pulsating shower head comprising:

an upper body housing having a cup shaped outer wall, a downstream extending inner wall and a center stem;

a lower body housing having an upstream end abutting the upper body housing inner wall;

a stem housing configured to fit within the lower body housing and being affixed thereto, said stem housing having an upstream portion comprising a substantially cylindrical wall with at least two apertures disposed therein for directing water flow, and a downstream portion comprising a substantially cylindrical wall having internally facing threads;

a stem configured to be received by the upper body housing center stem and having a tangentially outwardly facing groove for holding a rubber gasket and a circumferential groove downstream of the tangentially outwardly facing groove for holding a second rubber gasket, said rubber gaskets providing a sliding watertight seal between the stem and the stem housing;

a spray plate having a transverse wall with a first set of jet-discharging apertures therethrough and inner and outer substantially cylindrical walls extending upstream from the transverse wall, said outer wall threadedly affixed to the downstream portion of the stem housing, said transverse and cylindrical walls defining an annular rotor chamber, said transverse wall and said lower body housing defining a second set of jet-discharging apertures;

a nozzle plate interposed between the spray plate transverse wall and the downstream portion of the stem housing and held in fixed relation therewith, said nozzle plate having a plurality of tangentially directed flow channels which direct jets of water downstream thereof into the rotor chamber at a rotor driving velocity; and a rotor rotatably mounted in said rotor chamber;

wherein rotation of the lower body housing and stem housing relative to the stem causes the selective discharge of either a pulsed spray through the first set of jet-discharge apertures or a continuous spray through the second set of jet-discharge apertures, or a combination of both pulse spray and jet spray.

2. The pulsating shower head of claim 1 wherein rotation of the lower body housing and the stem housing relative to the stem causes the rubber gasket held within the tangentially outwardly facing groove of the stem to close off one or more of the at least two apertures for directing water flow disposed in the stem housing cylindrical wall.

3. The pulsating shower head of claim 1 wherein the upper body housing further comprises two radially inwardly extending ribs spaced about 95 degrees apart, and the lower body housing further comprises a stepped rib which cooperates with the radially inwardly extending ribs to limit the movement of the lower body housing and stem housing relative to the upper body housing and stem.

4. The pulsating shower head of claim 1 wherein the rotor further comprises six equally circumferentially spaced vanes extending radially from a sleeve-type center hub, and arcuate shaped webs bridging the space included between four of the vanes.

* * * * *